US005658848A

United States Patent [19]

Abe et al.

[11] Patent Number: 5,658,848

[45] Date of Patent: Aug. 19, 1997

[54] TRANSPARENT FILM FOR RECORDING IMAGES

[75] Inventors: Toshihiro Abe, Otokuni-gun; Kanryo Terasawa, Joyo; Kazushi Miyata, Mishima-gun; Hirotaka Kameyama, Shiga-ken, all of Japan

[73] Assignee: Hitachi Maxell, Ltd., Osaka-fu, Japan

[21] Appl. No.: 518,880

[22] Filed: Aug. 24, 1995

[30] Foreign Application Priority Data

Aug. 24, 1994 [JP] Japan ..... 6-224218

[51] Int. Cl.[6] ..... B41M 5/035; B41M 5/38

[52] U.S. Cl. ..... 503/227; 428/195; 428/411.1; 428/913; 428/914

[58] Field of Search ..... 8/471; 428/195, 428/913, 411.1, 914; 503/227

[56] References Cited

U.S. PATENT DOCUMENTS 5,267,755 12/1993 Yamauchi et al. ..... 283/86

FOREIGN PATENT DOCUMENTS 60-229032 11/1985 Japan ..... 428/195

60-244590 12/1985 Japan ..... 428/195

63-074680 4/1988 Japan ..... 428/195

*Primary Examiner*—Bruce H. Hess

*Attorney, Agent, or Firm*—Birch, Stewart, Kolasch & Birch, LLP

[57] ABSTRACT

An image-recording transparent film comprising a flexible film transparent to visible light and a recording layer on which an image is formable with an image-forming apparatus and which is provided on a surface of said flexible film, in which at least a part of the film has an absorption peak in a wavelength range between 250 nm and 400 nm, an absorption peak in a wavelength range between 700 nm and 1200 nm, and an IR light transmission of 40% or less.

6 Claims, 5 Drawing Sheets

NK-124: 20 mg/l in chloroform
NK-2674: 20 mg/l in chloroform

IRG-002: 20 mg/l in acetone
IRG-022: 8 mg/l in dichloromethane

SIR-130: 20 mg/l in chloroform
SIR-159: 20 mg/l in chloroform

UNIVAL D50: 0.25 g/l in methanol
UNIVAL N35: 0.25 g/l in methanol

UVA-633L: 0.27 g/l in chloroform

TRANSPARENT FILM FOR RECORDING IMAGES

BACKGROUND OF THE INVENTION

1. Field of the Invention

The present invention relates to an image-recording transparent film on which images are recorded with an image-forming apparatus such as a copying machine, a printer, a plotter, and the like.

2. Description of the Related Art

In recent years, images, characters and the like are widely formed on a transparent film such as an overhead projector (OHP) sheet with an image-forming apparatus which forms the images by electrophotography, electrostatic recording, thermal transfer recording and so on, such as a copying machine, a printer, a plotter, etc. The transparent film has partly an opaque section or a highly reflective section to detect the presence, kind, side or position of the film with an optical (IR) sensor assembled in the image-forming apparatus (see Japanese Patent KOKAI Publication Nos. 244590/1985 and 74680/1988).

In the above prior arts which form the opaque section or the highly reflective section on a part of the transparent film, since a section which does not allow passage of visible light is formed, it forms a shadow which has no relationship with the recorded images when the images on the transparent film are projected on a screen by a projector. Such shadows make the images less visible since they overlap the image, and the appearance of the entire projected image is deteriorated.

To solve the above problem and avoid the deterioration of the entire projected image, it is proposed to provide a section which does not absorb visible light but absorbs light in an infrared region, on a transparent sheet such as an OHP sheet (see Japanese Patent KOKAI No. 229032/1985 and U.S. Pat. No. 5,146,087).

However, the transparent sheet having the section which does not absorb visible light but absorbs light in an infrared region has poor resistance to ultraviolet light. When such sheet is exposed to sunlight or fluorescent lighting for a long time, a dye contained in the section which does not absorb visible light but absorbs light in an infrared region discolors or fades, or a material which does not absorb visible light but absorbs light in an infrared region is decomposed so that the effect for absorbing the IR light is decreased. As a result, such section does not function as intended.

In general, when the image is formed on the OHP sheet with the image-forming apparatus, an oil is deposited on its surface. When the OHP sheet having the deposited oil is resupplied in the image-forming apparatus in error, the oil is transferred onto a sensitized drum or other part, so that it may damage the image-forming apparatus. To prevent the oil transfer or the damage of the image-forming apparatus, some means is devised on the image-forming apparatus or the OHP sheet to prevent the passage of the once image-formed sheet through the image-forming apparatus. Hitherto, only a visual inspection is possible to determine whether or not the oil is deposited on the OHP sheet after the sheet is passed through the image-forming apparatus.

SUMMARY OF THE INVENTION

An object of the present invention is to provide a transparent film which maintains good IR light absorbability and transparency even after being subjected to sunlight or fluorescent lighting for a long time, whereby the presence, kind, side or position of the film is confirmed after the image is formed thereon by the image-forming apparatus, and only the recorded image is projected on a screen by a projector.

Another object of the present invention is to provide a transparent film which can prevent the damage of the image-forming apparatus caused by deposition of an oil on the sensitized drum by designing the film so that an IR light transmission of a part of the film is increased after the film passes through the image-forming apparatus, whereby whether or not the film has passed through the image-forming apparatus is judged, and the film which has once passed through the image-forming apparatus is jammed in the apparatus.

According to a first aspect of the present invention, there is provided an image-recording transparent film comprising a flexible film transparent to visible light and a recording layer on which an image is formable with an image-forming apparatus and which is provided on a surface of said flexible film, wherein at least a part of said film has an absorption peak in a wavelength range between 250 nm and 400 nm, an absorption peak in a wavelength range between 700 nm and 1200 nm, and an IR light transmission of 40% or less.

In a preferred embodiment of the invention according to the first aspect, said at least a part of the image-recording transparent film contains an absorbing agent having an absorption peak in a wavelength range between 250 nm and 400 nm and an absorbing agent having an absorption peak in a wavelength range between 700 nm and 1200 nm.

According to a second aspect of the present invention, there is provided an image-recording transparent film comprising a flexible film transparent to visible light and a recording layer on which an image is formable with an image-forming apparatus and which is provided on a surface of said flexible film, wherein at least a part of said film has a coating layer which has an absorption peak in a wavelength range between 250 nm and 400 nm, an absorption peak in a wavelength range between 700 nm and 1200 nm, and an IR light transmission of 40% or less.

In a preferred embodiment of the invention according to the second aspect, said coating layer contains an absorbing agent having an absorption peak in a wavelength range between 250 nm and 400 nm and an absorbing agent having an absorption peak in a wavelength range between 700 nm and 1200 nm.

According to a third aspect of the present invention, there is provided an image-recording transparent film comprising a flexible film transparent to visible light and a recording layer on which an image is formable with an image-forming apparatus and which is provided on a surface of said flexible film, wherein at least a part of said film has an absorption peak in a wavelength range between 250 nm and 400 nm, an absorption peak in a wavelength range between 700 nm and 1200 nm, and an IR light transmission of 40% or less and, after being heated, an IR light transmission of at least 50%.

In a preferred embodiment of the invention according to the third aspect, said at least a part of the image-recording transparent film contains an absorbing agent having an absorption peak in a wavelength range between 250 nm and 400 nm, an absorbing agent having an absorption peak in a wavelength range between 700 nm and 1200 nm and a heat-melting organic powder.

According to a fourth aspect of the present invention, there is provided an image-recording transparent film comprising a flexible film transparent to visible light and a recording layer on which an image is formable with an image-forming apparatus and which is provided on a surface of said flexible film, wherein at least a part of said film has a coating layer which has an absorption peak in a wavelength range between 250 nm and 400 nm, an absorption peak in a wavelength range between 700 nm and 1200 nm, and an IR light transmission of 40% or less and, after being heated, an IR light transmission of at least 50%.

In a preferred embodiment of the invention according to the fourth aspect, said coating layer contains an absorbing agent having an absorption peak in a wavelength range between 250 nm and 400 nm, an absorbing agent having an absorption peak in a wavelength range between 700 nm and 1200 nm and a heat-melting organic powder.

In a preferred embodiment of the image-recording transparent film according to the present invention, the absorbing agent having the absorption peak in the wavelength range between 250 nm and 400 nm is a UV light absorber, and the absorbing agent having the absorption peak in the wavelength range between 700 nm and 1200 nm is an IR light absorber.

DETAILED DESCRIPTION OF THE INVENTION

The present invention will be explained by making reference to FIG. 1 which illustrates an example of the image-recording transparent film of the present invention.

Figure 1:
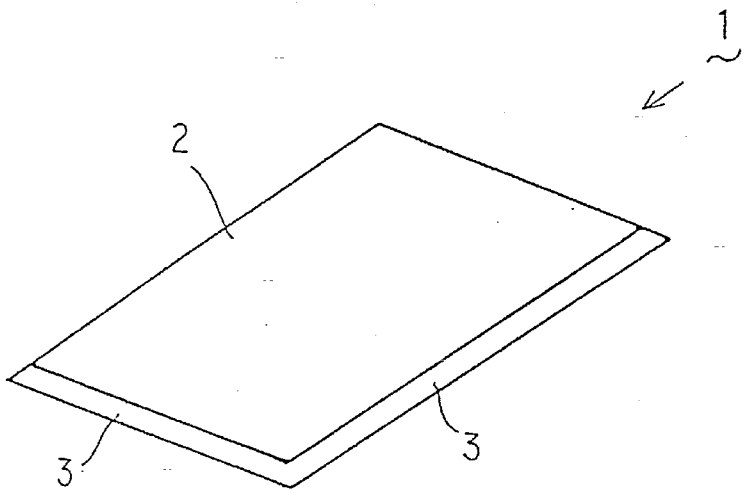
FIG. 1 is a perspective view of an example of the image-recording transparent film according to the present invention.

In FIG. 1, the image-recording transparent film 1 comprises a flexible film 2 having thereon a recording layer on which the image can be formed with the image-forming apparatus, and transparent coating layers 3 on a front edge and a left edge of the flexible film 2. The coating layers contain a UV light absorber and an IR light absorber.

The flexible film is made of a film of any suitable plastic such as polyethylene terephthalate, polybutylene terephthalate, polystyrene, polymethacrylate, polycarbonate, cellophane, cellulose acetate, and so on.

Since the image-recording film should be transparent in a visible wavelength range between 400 nm and 700 nm, preferably the coating layer 3 has a transmission to visible light of at least 50% of that of the flexible film 2. Further, since the presence, kind, side or position of the image-forming film 1 should be checked during the image-forming step in the image-forming apparatus, preferably the transmission to the IR and UV light of the coating layer is 40% or less of the transmission to the visible light of the flexible film 2. The coating layer 3 containing the IR light absorber and the UV light absorber may be identified by the eye with very careful checking, but actually is hardly visible to the eye. Accordingly, the image-recording film 1 is transparent as a whole.

When the image is formed on the image-recording transparent film 1 with the image-forming apparatus equipped with a detector of IR and UV light, the coating layer 3 containing the IR light absorber and the UV light absorber is detected by the detector to confirm the presence of the image-recording transparent film 1.

As the result, the supply, image forming and ejection of the image-recording transparent film 1 is automatically done as in the case of the conventional OHP sheet having the opaque section in the visible light range. When the formed image is projected on the screen by the projector, only the recorded image is projected. Then, different from the conventional OHP sheet, the section through which the visible light does not pass is not projected to form a shadow which has no relationship with the recording image, so that the clear image is projected on the screen, and the projected image has a good appearance.

In particular, since the coating layer 3 contains both the IR light absorber and the UV light absorber, the resistance to the UV light is not deteriorated. When the image-recording transparent film is exposed to the UV light, it does not discolor or fade, or the effect of absorbing the IR light is not decreased.

The coating layer 3 containing the IR light absorber and the UV light absorber may be formed by any of the conventional methods. For example, the IR light absorber, the UV light absorber, a binder resin, a solvent and other necessary additives are mixed and dispersed to obtain a paint containing the IR light absorber and the UV light absorber. In the case of the image-recording transparent film 1 of FIG. 1, the paint is coated on the front and left edges of the flexible film 2 and dried.

When a heat-melting organic powder is contained in the coating layer 3 together with the IR light absorber and the UV light absorber, it melts when the image-recording transparent film 1 passes through the image-forming apparatus and contacts a thermal head or a heat-sensitive roll, whereby the transmission to the IR light is increased.

Because of the increase of the transmission to the IR light due to the melting of the heat-melting organic powder in the coating layer 3, the image-recording transparent film 1 having the coating layer 3 containing the IR light absorber is judged whether or not the film has been passed through the image-forming apparatus. When the image-recording transparent film which has been passed through the image-forming apparatus is going to be passed through the apparatus again, the sheet is jammed by a suitable mechanism in the apparatus, whereby the damage of the image-forming apparatus caused by the deposition of the oil on the sensitizing drum is prevented.

Accordingly, it is possible to automatically carry out the supply, image forming and ejection of the image-recording transparent film 1 having the coating layer 3 which contains the heat-melting organic powder in addition to the IR light absorber and the UV light absorber. After image forming, only the recorded image is projected on the screen. The transparent film has good resistance to the UV light, and is prevented from being passed through the image-forming apparatus after it is once passed through the image-forming apparatus.

The heat-melting organic powder which is to be contained in the coating layer 3 preferably has a melting point of 40° to 100° C., a particle size of 0.1 to 30 μm, more preferably 1 to 5 μm.

The organic powder having a melting point of lower than 40° C. may cause blocking, while one having a melting point higher than 150° C. is not well molten when the film is contacted to the thermal heat or the heat-sensitive roll.

Specific examples of the heat-melting organic powder are waxes such as low molecular weight polyethylene powder, and so on.

The particle size of the heat-melting organic powder is preferably from one tenth to 5 times, more preferably from one fifth to 2 times an average thickness of the coating layer.

When the particle size is less than one tenth of the average thickness of the coating layer, the surface of the coating layer becomes too smooth so that light is not sufficiently scattered on the surface. When the particle size is larger than 5 times the average thickness of the coating layer, it is difficult to smooth the surface of the coating layer so that the transparency is deteriorated.

The content of the heat-melting organic powder is preferably from 10 to 50% by weight based on the total weight of the whole solid components in the coating layer 3.

When the coating layer 3 on the image-recording transparent film 1 should be visually identified, a slight amount of a coloring agent can be added to the coating layer 3. When the coloring agent is contained in the coating layer 3, a side (surface side or back side) of the image-recording transparent film 1 is easily judged. In this case, when the opacity of the coating layer 3 is less than 60%, a shadow of the coating layer 3 is faintly projected on the screen in comparison with the OHP sheet having the opaque section in the visible light region, so that the appearance of the entire projected image is not deteriorated.

As the coloring agent, a dye or a pigment may be used. Examples of the dye are nitroso dyes, azo dyes, stilbene dyes, diphenylmethane dyes, quinoline dyes, thiazole dyes, indophenol dyes, azine dyes, anthraquinone dyes, phthalocyanine dyes, sulfur dyes, and so on.

Examples of the IR light absorber to be contained in the coating layer 3 are anthraquinone compounds (e.g. IR-750 manufactured by Nippon Kayaku), metal complexes, (e.g. bis(dithiobenzyl)-nickel, SIR-130 manufactured by Mitsui-Toatsu), aminium compounds (e.g. IRG-002 manufactured by Nippon Kayaku), diimmonium compounds (e.g. IRG-022 manufactured by Nippon Kayaku), cyanine compounds (e.g. NI-124 manufactured by Nippon Kanko Shikiso Kenkyusho), benzopyrylium compounds (e.g. NK-2674 manufactured by Nippon Kanko Shikiso Kenkyusho), and so on.

Examples of the UV light absorber are benzophenone compounds (e.g. 2-hydroxy-4-methoxybenzophenone), benzotriazole compounds (e.g. 2-(2'-hydroxy-5-methylphenyl) benzotriazole), oxalic acid anilide compounds, cyanoacrylate compounds (e.g. 2-ethylhexyl-2-cyano-3,3'-diphenyl acrylate), triazine compounds, salicylic acid compounds (e.g. p-tert.-butylphenyl salicylate), cerium compounds and so on.

Examples of the binder resin are polyester resins, vinyl chloride-vinyl acetate copolymers, polyurethane resins, polyvinyl butyral resins, phenoxy resins, acrylic resins, and so on.

Examples of the solvent are ketones (e.g. methyl ethyl ketone, cyclohexanone, methyl isobutyl ketone, tetrahydrofuran, etc.), aromatic hydrocarbons (e.g. toluene, xylene, etc.), butyl-cellulose, alcohols (e.g. methanol, ethanol, propanol, isopropanol, etc.), water, and so on.

The coating layer 3 may optionally contain one or more additives such as an antistatic agent, a matting agent, a crosslinking agent, an abrasive, and so on.

The coating layer may be provided on any part of the surface of the flexible film 2. For example, the coating layer may cover the whole periphery of the flexible film 2, or two or more areas at different positions on the flexible film 2. The coating layer may be present on either one or both of the surfaces of the flexible film 2. Alternatively, the coating layer may be present between the flexible film 2 and the recording layer on which the image can be formed with the image-forming apparatus.

In the above explained embodiments, the coating layer contains the IR light absorber, the UV light absorber, and optionally the heat-melting organic powder and the coloring agent.

In other embodiments, the IR light absorber, the UV light absorber, and optionally the heat-melting organic powder and the coloring agent may be contained in either one or both of the flexible film and the recording layer.

EXAMPLES

The present invention will be illustrated by the following Examples, which do not limit the scope of the present invention in any way.

Example 1

The following components were mixed to prepare a paint for absorbing IR and UV light:

| Component | wt. part |
|---|---|
| NK-124 (a cyanine compound IR light absorber manufactured by Nippon Kanko Shikiso Kenkyusho) | 0.1 |
| NK-2674 (a benzopyrylium compound IR light absorber manufactured by Nippon Kanko Shikiso Kenkyusho) | 0.1 |
| IRG-002 (an aminium compound IR light manufactured by Nippon Kayaku) | 0.1 |
| IRG-022 (a diimmonium compound IR light manufactured by Nippon Kayaku) | 0.1 |
| SIR-130 (a metal complex compound IR light absorber manufactured by Mitsui-Toatsu Senryo) | 0.1 |
| SIR-159 (a metal complex compound IR light absorber manufactured by Mitsui-Toatsu Senryo) | 0.1 |
| UNIVUL D50 (an UV light absorber manufactured by BASF) | 0.1 |
| UNIVUL N35 (an UV light absorber manufactured by BASF) | 0.1 |
| UVA-633L (an UV light absorber manufactured by BASF) | 0.1 |
| VILON RV 290 (a polyester resin manufactured by TOYOBO) | 10 |
| Triethanolamine dioctylphosphate (an antistatic agent) | 0.2 |
| Methyl ethyl ketone | 100 |

Separately, on both surfaces of a transparent polyethylene terephthalate film having a thickness of 100 μm, a polyester resin (VILON RV 290) on which a toner can be fixed was coated to a thickness of 5 μm each. Then, the coated film was cut to obtain a A4-size polyethylene terephthalate film. On the left and front edges (a width of 0.95 cm each) of this cut sheet, the above prepared paint was gravure coated and dried to form coating layers each having a thickness of 2 μm, whereby an image-recording transparent film was obtained.

Example 2

In the same manner as in Example 1 except that 0.1 wt. part of VICTORIA BLUE (a blue dye manufactured by TOKYO KASEI) was added to the paint composition, an image-recording transparent film was produced.

Example 3

In the same manner as in Example 1 except that 0.05 wt. part of titanium oxide (TTO-55(A) manufactured by ISHIHARA SANGYO) was added to the paint composition, an image-recording transparent film was produced.

Example 4

In the same manner as in Example 1 except that 3 wt. parts of a heat-melting organic powder (FLOW BEADS manufactured by SUMITOMO SEIKA) was added to the paint composition, triethanolamine dioctylphosphate was not used, 8.8 wt. parts of polyvinyl butyral resin was used in place of VILON RV290, a mixture of 4.5 wt. parts of cyclohexanone and 5 wt. parts of toluene was used in place of methyl ethyl ketone, and the thickness of the coating layer was changed from 2 μm to 6 μm, an image-recording transparent film was produced.

Comparative Example 1

In the same manner as in Example 1 except that UNIVUL D50, UNIVUL N35 and UVA-633L were not used, an image-recording transparent film was produced.

Comparative Example 2

In the same manner as in Example 1 except that UNIVUL D50, UNIVUL N35 and UVA-633L were not used, but 0.1 wt. part of VICTORIA BLUE as used in Example 2 was added to the paint composition, an image-recording transparent film was produced.

Comparative Example 3

In the same manner as in Example 1 except that UNIVUL D50, UNIVUL N35 and UVA-633L were not used, but 0.05 wt. part of titanium oxide as used in Example 3 was added to the paint composition, an image-recording transparent film was produced.

Comparative Example 4

In the same manner as in Example 4 except that UNIVUL D50, UNIVUL N35, UVA-633L and LA-62 were not used, an image-recording transparent film was produced.

Figure 2:
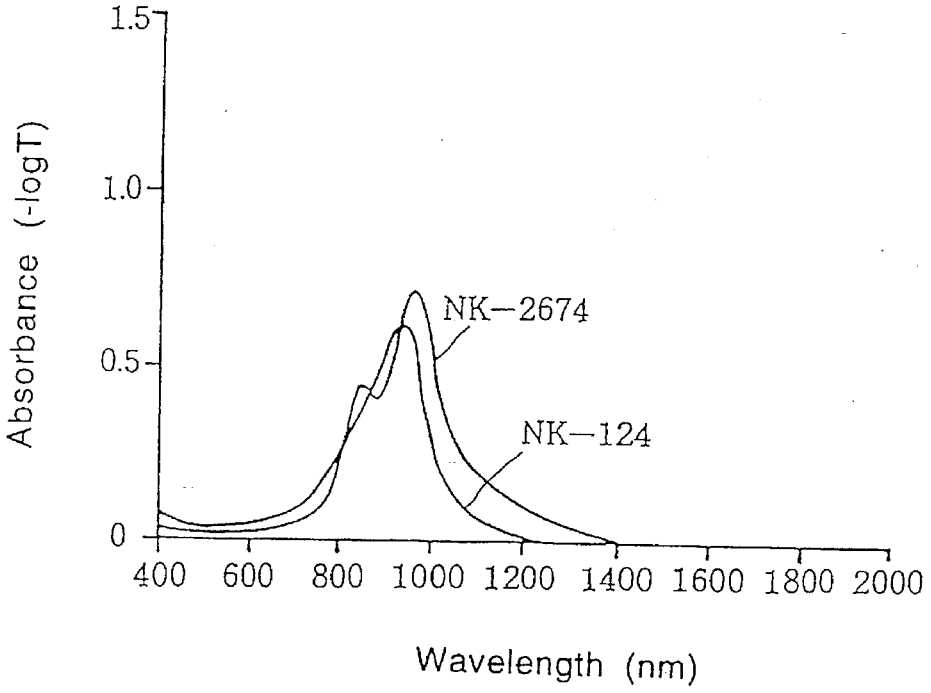
FIGS. 2, 3 and 4 show absorption spectra of the IR light absorbers used in the Examples.
Figure 3:
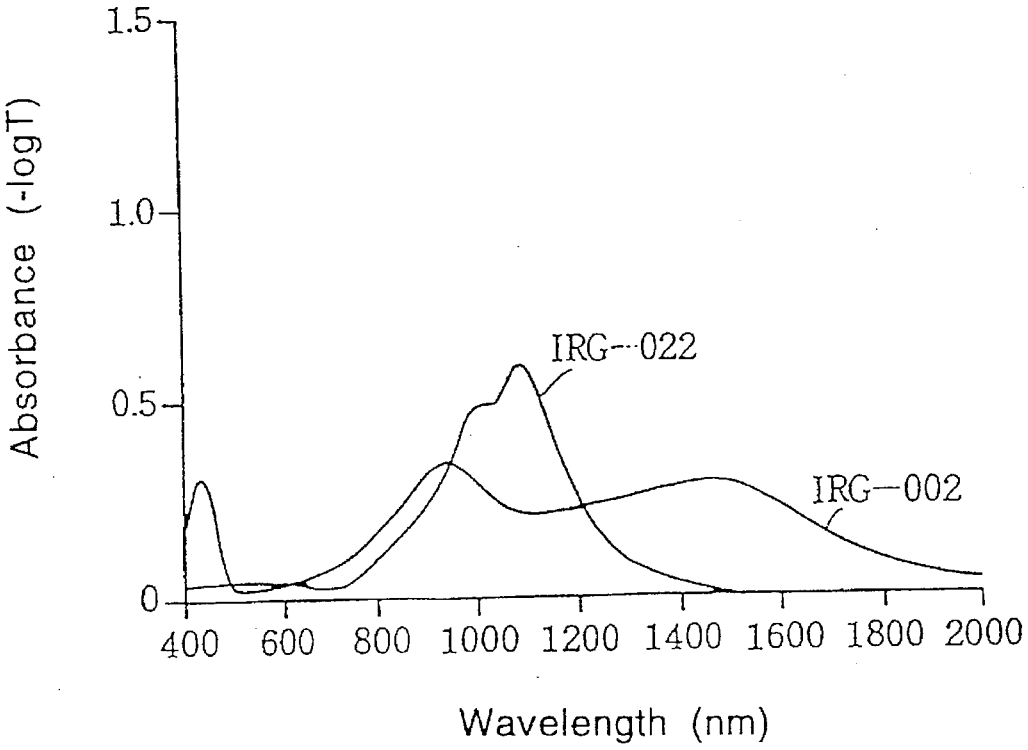
Figure 4:
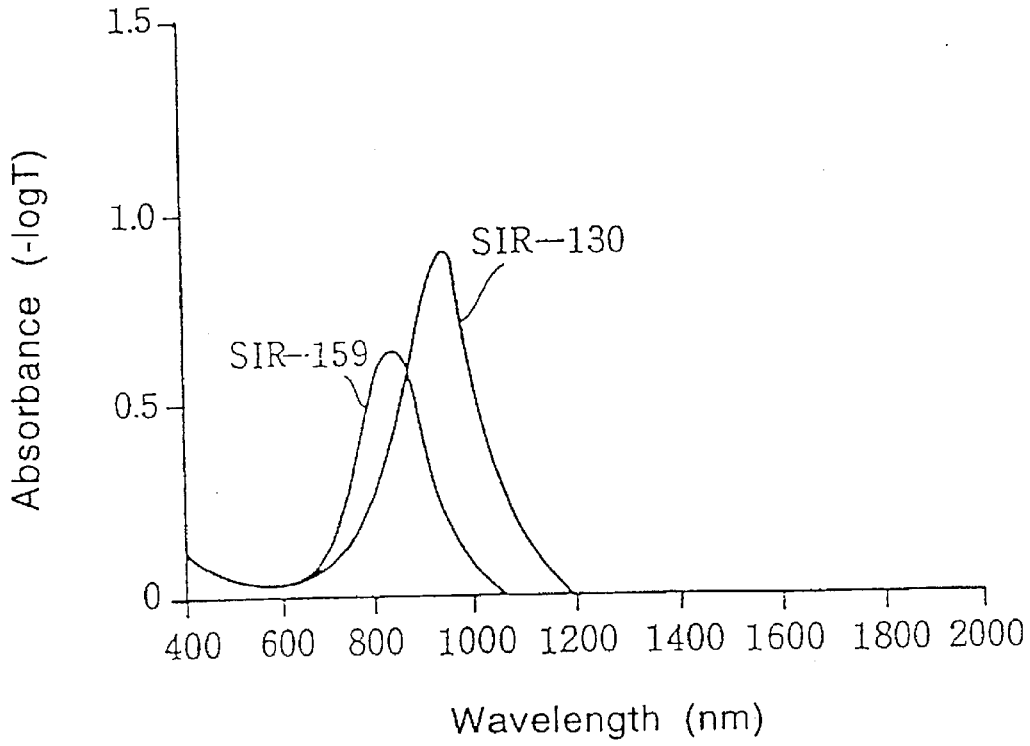
Figure 5:
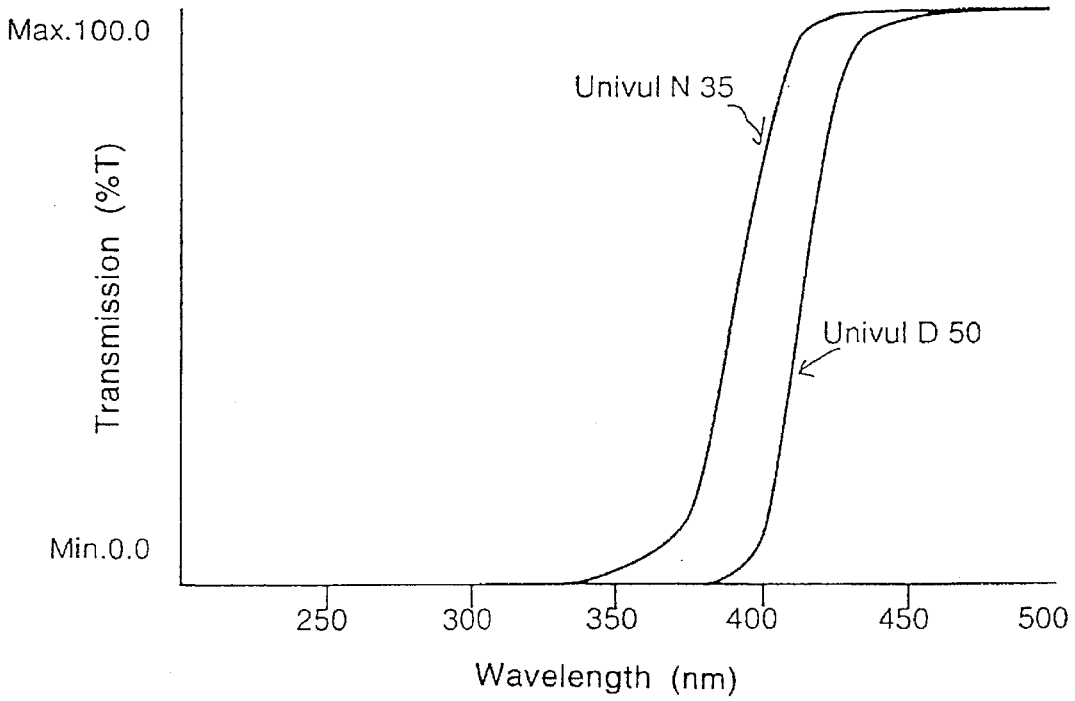
FIGS. 5 and 6 show transmission spectra of the UV light absorbers used in the Examples.
Figure 6:
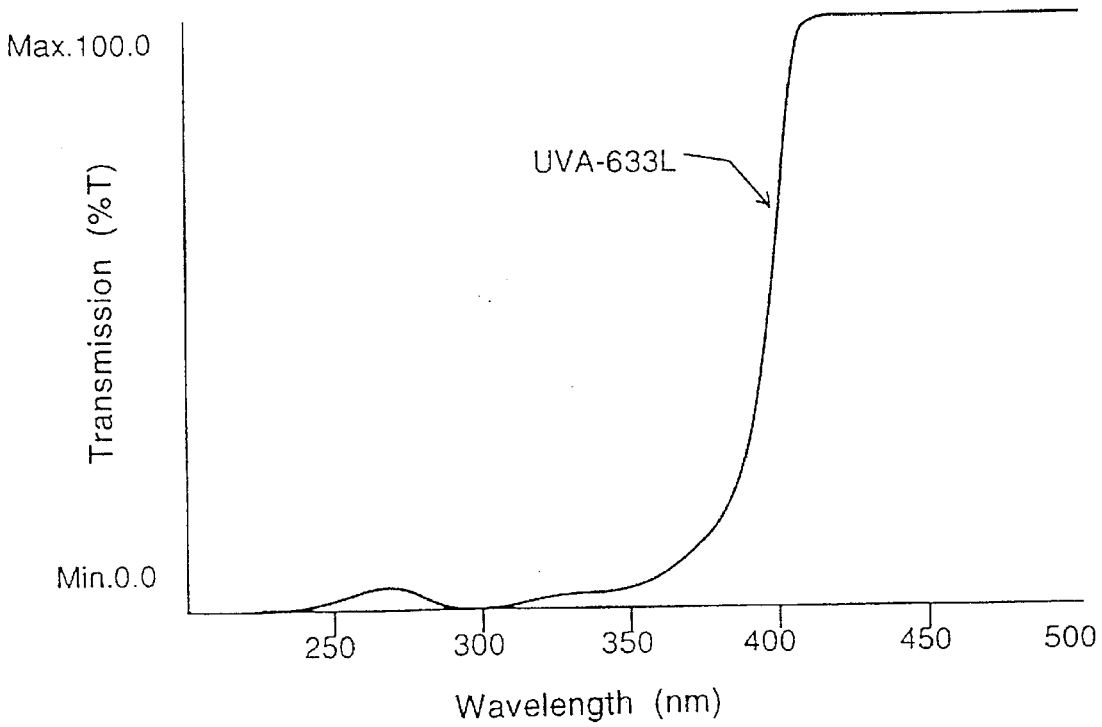

FIGS. 2, 3 and 4 show absorption spectra of the IR light absorbers used in the Examples, and FIGS. 5 and 6 show transmission spectra of the UV light absorbers used in the Examples.

With each of the image-recording transparent films produced in Examples and Comparative the Examples, a transmission of visible light having a wavelength of 500 nm was measured using a spectrophotometer (manufactured by UNISOKU). Each film had the transmission of 90%.

On each of the image-recording transparent films produced in the Examples and Comparative Examples, an image was printed using an image-forming apparatus (a color laser copier manufactured by CANON). With each film, no setting mistake was observed, and the image-recording transparent film carrying the image only was obtained.

The image printed on the image-recording transparent film as above was projected using an overhead projector. On a screen, only the image printed on the transparent film was clearly projected.

Each of the image-recording transparent films produced in the Examples and Comparative Examples and a reference film (an OHP film transparency for a color laser copier manufactured by CANON) was maintained in a CI 65 Weather-O-meter (manufactured by ATLAS, USA) at 45° C./50% RH for 48 hours. Before and after the maintenance in the Weather-O-meter, a transmission of IR light having a wavelength of 950 nm was observed. In addition, whether or not the film was recognized as a film was checked by passing it through a copying machine. The results are ranked as "O" when recognized as a film or "X" when not recognized as a film.

With the image-recording transparent films produced in the Examples and Comparative Examples and also the reference film, the appearance of the projected image was observed. When the projected image was good, the film was ranked "O", but when the image was no good, the film was ranked "X".

With the image-recording films produced in Examples 2 and 3 and Comparative Examples 2 and 3, and also the reference film, whether or not the presence of the coating layer could be identified visually was checked. When the coating layer was visually identified, the film was ranked "O", while when the coating layer was not visually identified, the film was ranked "X".

With the image-recording film produced in Example 4 and Comparative Example 4 and also the reference film, an effect for preventing recopying was tested by checking whether or not the once copied film could be jammed in the copying machine. When the film was jammed and recopying was impossible, it was ranked "O", while when the film was not jammed and recopied, it was ranked "X".

The results are shown in Tables 1 and 2.

TABLE 1

| | IR transmission (%) | | Film recognition | |
|---|---|---|---|---|
| Ex. No. | Before UV irradiation | After UV irradiation | Before UV irradiation | After UV irradiation |
| Ex. 1 | 15 | 17 | O | O |
| Ex. 2 | 12 | 15 | O | O |
| Ex. 3 | 9 | 12 | O | O |
| Ex. 4 | 10 | 12 | O | O |
| C. Ex. 1 | 13 | 55 | O | X |
| C. Ex. 2 | 12 | 60 | O | X |
| C. Ex. 3 | 9 | 75 | O | X |
| C. Ex. 4 | 10 | 10 | O | X |
| Reference | 0 | 0 | O | O |

TABLE 2

| Ex. No. | Visual identification | Prevention of recopying | Appearance of projected image |
|---|---|---|---|
| Ex. 1 | — | — | O |
| Ex. 2 | O | — | O |
| Ex. 3 | O | — | O |
| Ex. 4 | — | O | O |
| C. Ex. 1 | — | — | O |
| C. Ex. 2 | O | — | O |
| C. Ex. 3 | O | — | O |
| C. Ex. 4 | — | X | O |
| Reference | O | X | X |

What is claimed is:

1. An image-recording transparent film, comprising:

a flexible film substrate that is transparent to visible light and a recording layer on which an image is formable with an image-forming apparatus and which is provided on a surface of said flexible film substrate, wherein at least a part of said image-recording transparent film has an absorption peak in a wavelength range between 250 nm and 400 nm, an absorption peak in a wavelength range between 700 nm and 1200 nm, and an IR light transmission of 40% or less, and wherein said at least part of the image-recording transparent film substrate contains a UV absorbing agent having an absorption peak in a wavelength range between 250 nm and 400 nm and an IR absorbing agent having an absorption peak in a wavelength range between 700 nm and 1200 nm.

2. An image-recording transparent film, comprising:

a flexible film substrate that is transparent to visible light and a recording layer on which an image is formable with an image-forming apparatus and which is provided on a surface of said flexible film, wherein at least a part of said image-recording transparent film has a coating layer which has an absorption peak in a wavelength range between 250 nm and 400 nm, an absorption peak in a wavelength range between 700 nm and 1200 nm, and an IR light transmission of 40% or less, and wherein said coating layer contains an UV absorbing agent having an absorption peak in a wavelength range between 250 nm and 400 nm, and an IR absorbing agent having an absorption peak in a wavelength range between 700 nm and 1200 nm.

3. The image-recording transparent film according to claim 2, wherein said coating layer is colored to an extent that its opacity is less than 60%.

4. The image-recording transparent film according to claim 2, wherein said coating layer has a transmission to visible light of at least 50% of that of said flexible film substitute.

5. An image-recording transparent film, comprising:

a flexible film substrate that is transparent to visible light and a recording layer on which an image is formable with an image-forming apparatus and which is provided on a surface of said flexible film, wherein at least a part of said image recording transparent film has an absorption peak in a wavelength range between 250 nm and 400 nm, an absorption peak in a wavelength range between 700 nm and 1200 nm, and an IR light transmission of 40% or less and, after being heated, an IR light transmission of at least 50%, wherein at least a part of the image-recording transparent film has a coating layer that contains an UV absorbing agent having an absorption peak in a wavelength range between 250 nm and 400 nm, and an IR absorbing agent having an absorption peak in a wavelength range between 700 nm and 1200 nm and a heat-melting organic powder.

6. An image-recording transparent film, comprising:

a flexible film substrate that is transparent to visible light and a recording layer on which an image is formable with an image-forming apparatus and which is provided on a surface of said flexible film, wherein at least a part of the image recording transparent film has a coating layer which has an absorption peak in a wavelength range between 250 nm and 400 nm, an absorption peak in a wavelength range between 700 nm and 1200 nm, and an IR light transmission of 40% or less and, after being heated, an IR light transmission of at least 50%, and wherein said coating layer contains an UV absorbing agent having an absorption peak in a wavelength range between 250 nm and 400 nm, and an IR absorbing agent having an absorption peak in a wavelength range between 700 nm and 1200 nm and a heat-melting organic powder.

* * * * *